US005655608A

United States Patent [19]

Sundholm

[11] Patent Number: 5,655,608

[45] Date of Patent: Aug. 12, 1997

[54] FIRE FIGHTING EQUIPMENT

[76] Inventor: Göran Sundholm, Ilmari Kiannon kuja 3, SF-04310 Tuusula, Finland

[21] Appl. No.: 405,437

[22] Filed: Mar. 14, 1995

Related U.S. Application Data

[63] Continuation of Ser. No. 946,300, filed as PCT/FI92/00155, May 20, 1992 published as WO92/20453, Nov. 26, 1992, abandoned.

[30] Foreign Application Priority Data

| | | | |
|---|---|---|---|
| May 20, 1991 | [FI] | Finland | 912434 |
| Jun. 20, 1991 | [FI] | Finland | 913059 |
| Oct. 4, 1991 | [FI] | Finland | 914704 |
| Oct. 28, 1991 | [FI] | Finland | 915078 |

[51] Int. Cl.[6] ..... B05B 1/34

[52] U.S. Cl. ..... 169/90; 169/62; 169/20; 239/446; 239/563

[58] Field of Search ..... 169/90, 37, 60, 169/61, 62, 5, 13, 14, 20; 239/446, 444, 551, 563, 556

[56] References Cited

U.S. PATENT DOCUMENTS

| | | | |
|---|---|---|---|
| 3,592,270 | 7/1971 | Livingston | 169/37 |
| 3,684,194 | 8/1972 | Wayne . | |
| 4,590,999 | 5/1986 | Snaper | 169/37 |
| 4,991,658 | 2/1991 | Shlomo | 169/62 |

FOREIGN PATENT DOCUMENTS

| | | | |
|---|---|---|---|
| 3440901 | 7/1985 | Germany . | |
| 0058298 | 5/1977 | Japan | 169/90 |
| 4-266775 | 9/1992 | Japan | 169/13 |
| 435990 | 11/1967 | Switzerland . | |
| 2076696 | 12/1981 | United Kingdom . | |
| 8905195 | 6/1989 | WIPO . | |

*Primary Examiner*—David M. Mitchell
*Attorney, Agent, or Firm*—Ladas & Parry

[57] ABSTRACT

The present invention relates to a fire fighting equipment, comprising at least one spray head (1) with a number of nozzles (3) directed obliquely sideways. The nozzles (3) are arranged so close to each other that the fog formation areas of the individual nozzles intensify the fog flows and provide a suction to cause the fog formation areas to be compressed into a continuous directional fog spray.

9 Claims, 3 Drawing Sheets

FIRE FIGHTING EQUIPMENT

This is a continuation of application Ser. No. 07/946,300 filed on Nov. 2, 1992, now abandoned, and International Application PCT/FI92/00155 filed on May 20, 1992, published as WO92/20453, Nov. 26, 1992, and which designated the U.S.

BACKGROUND OF THE INVENTION

The present invention relates to a fire fighting method and system having at least one spray head with nozzles directed obliquely sideways.

SUMMARY OF THE INVENTION

The object of the invention is to provide strong penetrating power and a low consumption of fire extinguishing liquid.

The fire fighting method and system according to the invention is mainly characterized in that (1) the nozzles are arranged to spray high pressure extinguishing liquid in fog-like formations and that (2) the nozzles are arranged so close to each other that the fog-like formations of the nozzles intensify each other with a suction that causes the fog-like formations to be compressed (i.e. concentrated or entrained) into a single directional fog spray (i.e. flow pattern).

By means of such a directional fog spray, it is possible to extinguish fire considered extremely difficult to extinguish in a short time and with a small amount of water.

Getting the fog spray concentrated (i.e. compressed or entrained) as desired depends on several parameters, such as individual spread angles and mutual main directions of each nozzle as well as on the drop size. A large individual spread angle facilitates contract of the fog-like formations of adjacent nozzles and thus then total concentration by means of the suction. The resulting fog flow pattern has a resemblance to a sponge with a relatively round head.

The concentration becomes stronger with increasing operating pressure. The higher pressure, the more the fog-like formations turn rapidly toward each other and are concentrated, compressed or entrained thereafter. The concentration effect can be assured by use of oblique directed nozzles and a nozzle directed centrally straight downwards.

In order to secure necessary suction inward and downward when the spray head is mounted on a ceiling, a certain space of e.g. a couple of centimeters shall preferably exist between the ceiling and the openings of the nozzles. Flue gases generated by the fire then will be sucked into the extinguishing liquid fog spray and will thereby be cooled and at least partially purified.

With the concentration of the respective fog-like formations, the drops therein will collide with one another and split into smaller one, which improves their extinguishing effect.

The initial size of the fog drops should not be too big, however, because the fog-like formations of the respective nozzles then risk losing the mutual contact necessary for forming the common fog spray.

The proper drop size as well as the other parameters at different operating pressures can be determined by testing.

Each nozzle preferably comprises a nozzle socket fastened inside a housing of the spray head. In the socket are a mouthpiece and, with a contact surface bearing against it, a whirler which, together with the mouthpiece, defines a whirl chamber. The whirler is supported in the housing in such a way that the whirler is set in rotation by the liquid pressure.

The contact surface of the whirler against the mouthpiece preferably comprises at least one oblique groove for leading the extinguishing liquid into the whirl chamber.

The spray head is preferably operated by a high pressure of extinguishing liquid at, e.g., 100 bar or more to provide the so-called fog-like formations. The high operating pressure sets the whirler in high-speed rotation, which gives the small drops strong turbulence. This results in increased extinction effect.

The whirler can preferably be supported in the housing via a filter and an elastic sealing means positioned between the whirler and the filter.

A nozzle formed in this way can be manufactured in a length of about 10 to 12 mm, while conventional nozzles have lengths of about 35 to 40 mm. A spray head of metal provided with, e.g., four nozzles according to the invention has a weight of about 600 g, while a corresponding spray head provided with conventional nozzles weighs about 3 to 4 kg.

A preferred embodiment of the fire fighting equipment of the invention is characterized in several ways. A spray head has a nozzle positioned centrally with respect to nozzles directed obliquely sideways. A connection channel for the extinguishing liquid extends from an inlet into the spray head to the centrally positioned nozzle. Branches of the channel extends to the nozzles that are directed obliquely sideways. A spindle having a connection to the centrally positioned nozzle is in the channel. The spindle is subjected to a force tending to press the spindle against the liquid pressure in the inlet of the spray head to close the branches to the nozzles directed obliquely sideways, while the connection to the centrally positioned nozzle remains open.

The extinguishing liquid has a reducible operating pressure so that the higher pressure at a first stage of operation overcomes the force on the spindle and the extinguishing liquid is sprayed out through all the nozzles, but the lower pressures at a second stage of operation is overcome by the force on the spindle and the extinguishing liquid is then sprayed out only through the centrally positioned nozzle.

This embodiment can preferably be used for fighting fires in engine rooms of ships and in spaces comparable to them. According to the prevailing opinion, effective fire fighting within a fire zone in an engine room presupposes an amount of water of up to about 500 to 600 liters per minute. To achieve this by means a pump delivering water directly from a tank, a power of about 130 to 140 kW is required for the pump. The invention also relates, therefore, to an effective fire-fighting method and system with lower requirements.

This is characterized in several ways. A liquid pump providing a high operating pressure but a volume capacity considerably lower than the amount of water or other extinguishing liquid required per unit time is arranged to charge a number of hydraulic accumulators in the rest state of the installation. The hydraulic accumulators are connected in parallel by main line to deliver to extinguishing liquid to a spray head when a fire is discovered. The main line to the spray head is arranged to be closed after the hydraulic accumulators have been emptied of the high operating pressure for a recharge of the accumulators and, if necessary for delivery of more extinguishing water.

For instance, five hydraulic accumulators of 50 liters each can be connected parallel and charged to a high operating pressure of about 200 bar. These can be discharged to a pressure of about 50 bar before recharging and still be capable of delivering a sufficient amount of water quickly enough to extinguish a fire. In this case, the water can use a power as low as 15 kW and have a volume capacity of about 35 liters per minute.

BRIEF DESCRIPTION OF THE DRAWING

In the following, the invention will be described with reference to exemplifying embodiments shown schematically in the enclosed drawing in which.

Figure 1:
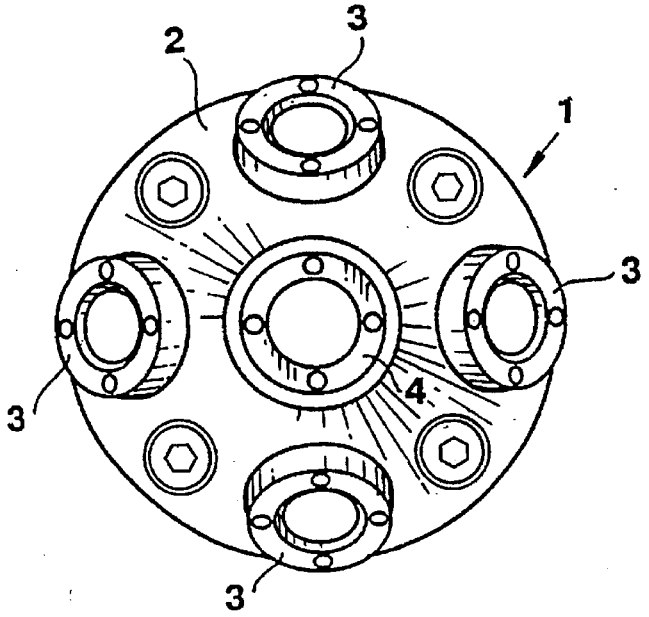
FIG. 1 is an end view of a spray head.
Figure 2:
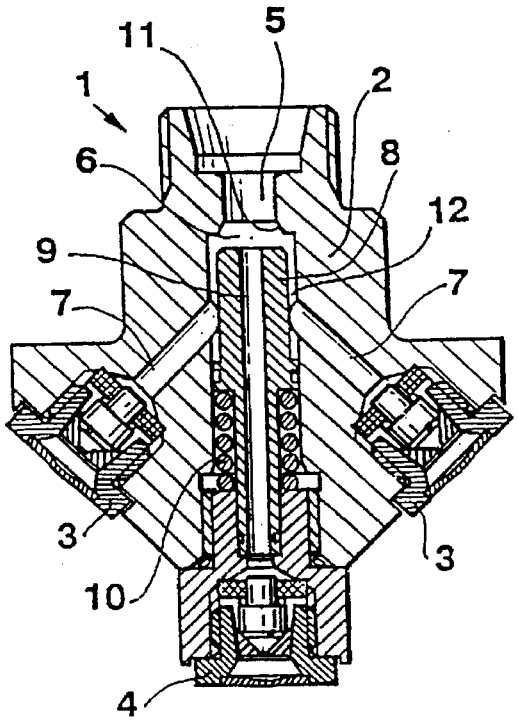
FIG. 2 is a longitudinal cross section of the spray head according to FIG. 1, the spray head being in a first activated state for extinguishing a fire.
Figure 3:
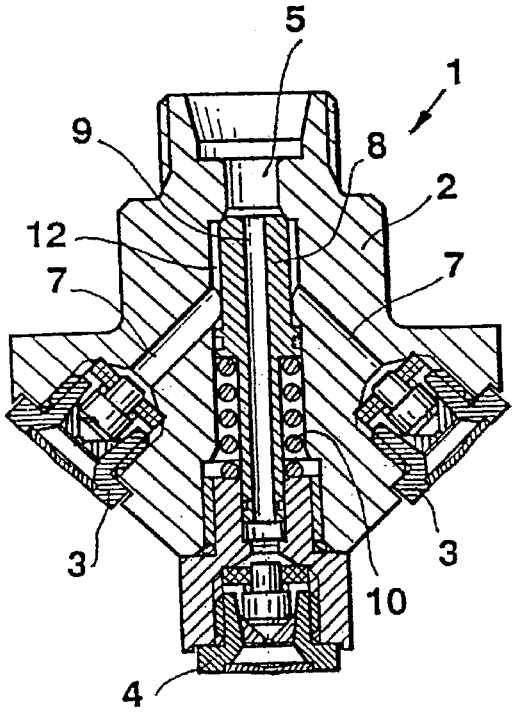
FIG. 3 is a longitudinal cross section like FIG. 2 through the spray head according to FIG. 1, the spray head being in a second activated state for a cooling function after a fire is extinguished.

In the FIGS. 1 to 3, a spray head 1 has a housing or body 2 and four nozzles 3 directed obliquely downwards and to the side of an axis of the spray head. A nozzle 4 is directed axially and downward centrally with respect to the side nozzles 3.

An inlet 5 into the spray head for extinguishing liquid extends into an axial channel or boring 6 from which branch channels or borings 7 extend to the side nozzles 3. In the axial boring 6 is a spindle 8 with a axial passage or boring 9 leading from the inlet to the centrally positioned nozzle 4.

A spring 10 is arranged to press one end of the spindle 8 against a shoulder 11 (FIG. 2) in the inlet 5.

If the pressure acting on the end of the spindle 8 via the inlet 5 overcomes the force of the spring 10, the spindle 8 takes a position according to FIG. 2. In this position, liquid can flow from the inlet 5 through the boring 9 of the spindle 8 to the centrally positioned nozzle 4 and, via an annular space 12 between the spindle 8 and a wall of the boring 6, through the branch borings 7 to the side nozzles 3.

If the force of the spring 10 overcomes the pressure on the end of the spindle in the inlet 5, the spindle 8 takes a position according to FIG. 3. In this position, the end of the spindle 8 contacts the shoulder 11 of the inlet 5 to close its connection to the side nozzles 3 through the annular space and branch borings while the connection of the inlet to the centrally positioned nozzle 4 remains open through the channel through the spindle.

Figure 6:
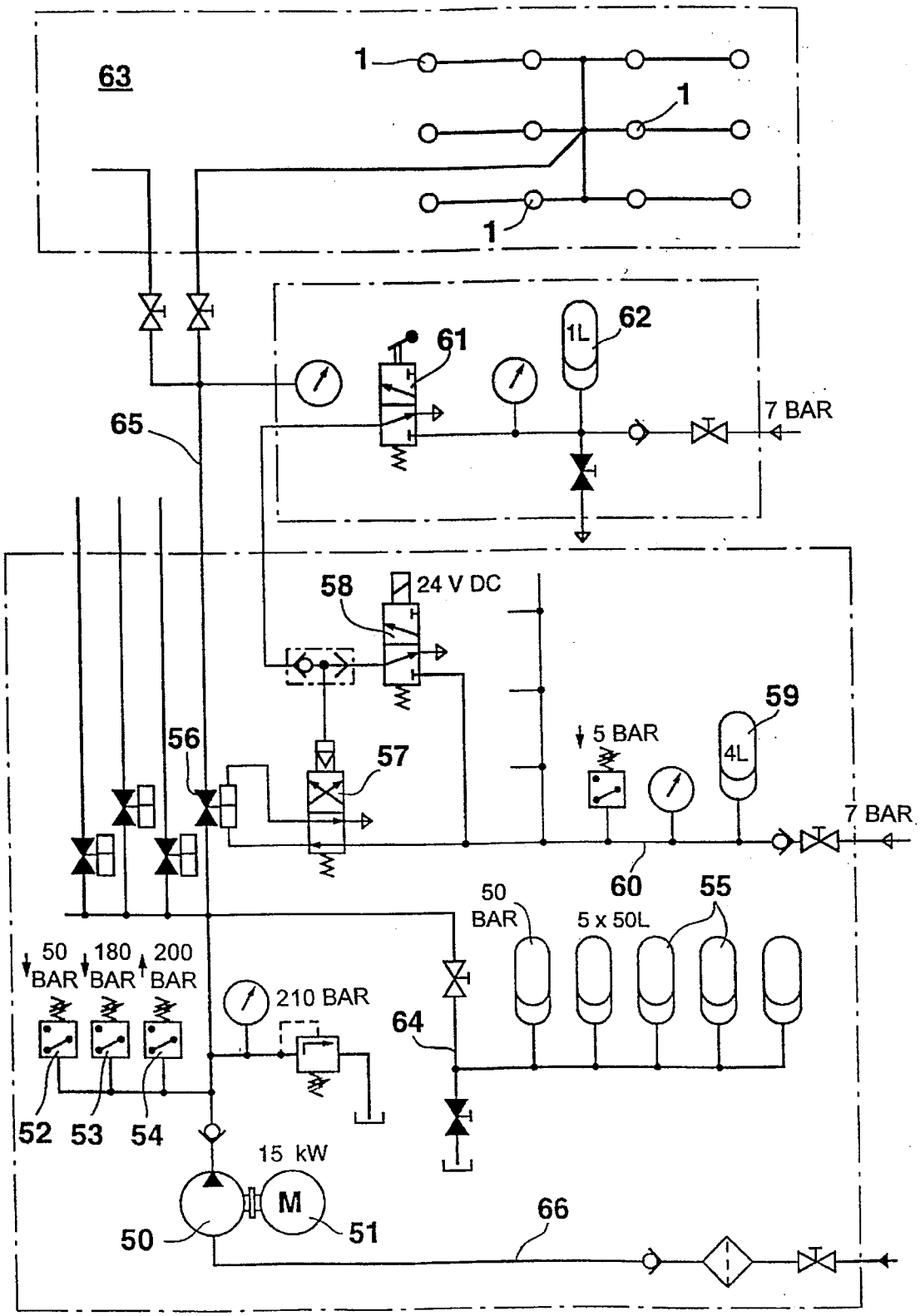
FIG. 6 shows schematically an example of an installation in which the spray heads according to FIGS. 1 to 3 preferably can be used.

A spray head according to FIGS. 1 to 3 is especially suitable for being used for fire fighting in engine rooms of ships, and spaces comparable to them. It is preferred to use a number of hydraulic accumulators connected in parallel as the drive and supply for extinguishing liquid (water) for such spray heads in an installation as shown in FIG. 6.

Initially, the water pressure from such hydraulic accumulators is so high that each spindle 8 of the spray heads 1 takes a position according to FIG. 2, whereby liquid is sprayed out through all nozzles for extinguishing the fire. As the hydraulic accumulators approaching discharge, however, the water pressure falls in the inlets 5 of the spray heads and the spray heads 8 take the position according to FIG. 3. The rest of the water from the accumulators then is sprayed out through the central nozzles 4 alone for cooling the fire scene.

Figure 4:
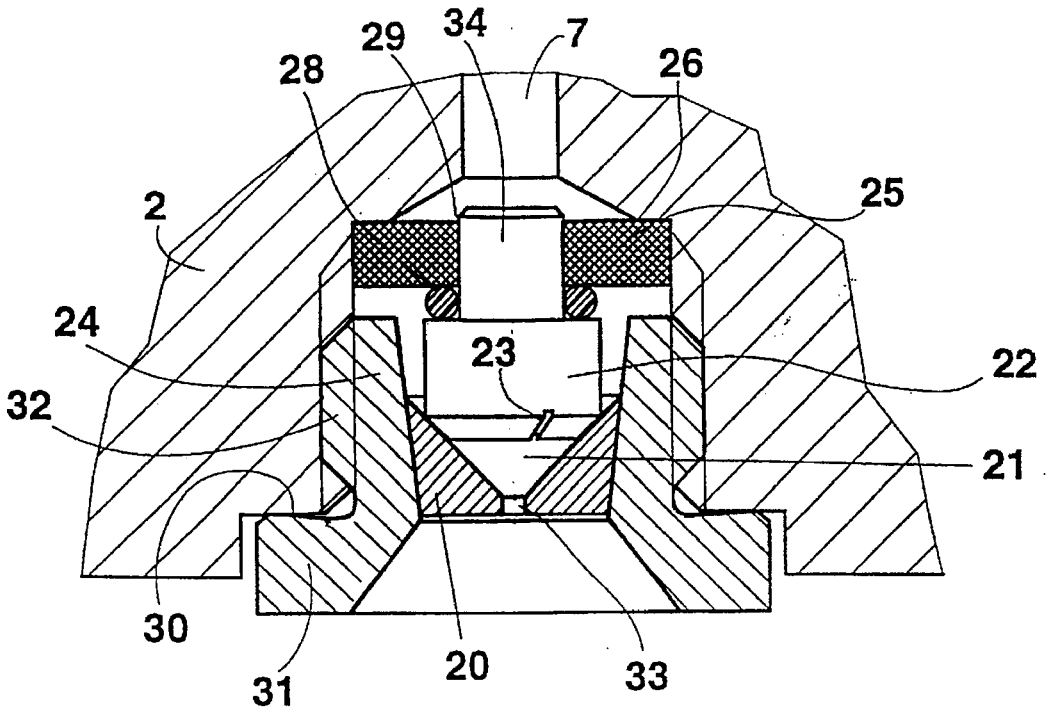
FIG. 4 is an enlarged cross-sectional elevation of a preferred embodiment of a nozzle of the spray head according to FIG. 1.
Figure 5:
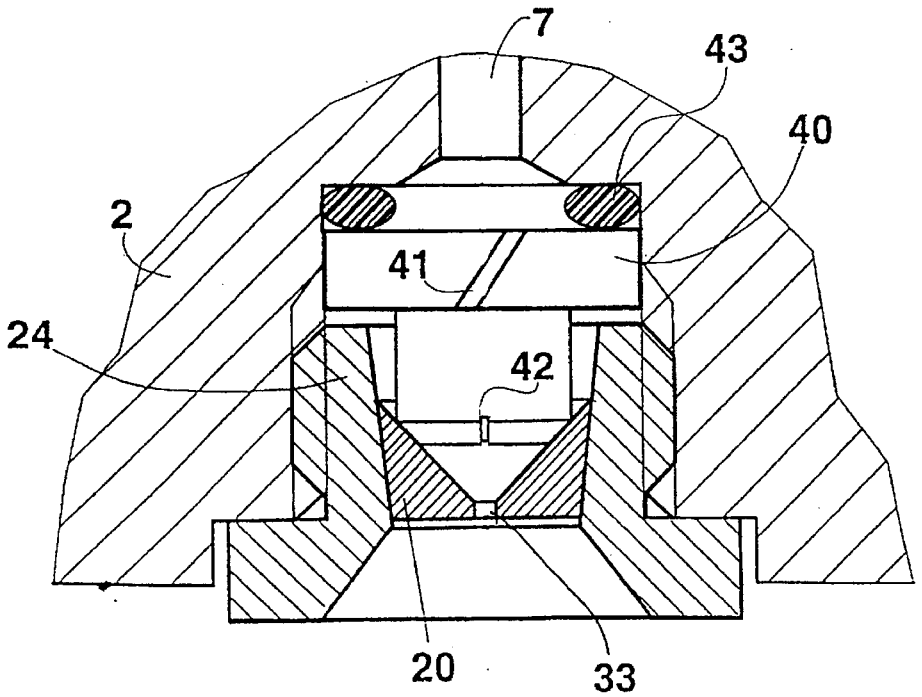
FIG. 5 is an enlarged cross-sectional elevation like FIG. 4, but of an alternative embodiment of a nozzle for the spray head according to FIG. 1.

In FIGS. 4 and 5, mouthpieces 20 in sockets 24 of the nozzles spread the extinguishing liquid into fog-like drop formations. For this, the liquid in spaces 21 at outlets 33 of the mouthpieces 20 must be subjected to a strong whirling motion. This is provided by means of whirlers 22, 22', which bear against the mouthpieces 20.

The contact surface of whirler 22 against the inner conical surface mouthpiece 20 in the embodiment of FIG. 4 is provided with at least one oblique groove 23 and, preferably, four grooves (not shown) for the extinguishing liquid that flows in from a feed channel 7 through a disc filter 25, which preferably a sintered metal filter. The groove 23 leads the extinguishing liquid to the whirl chamber 21 to whirl the whirler and, thus, the extinguishing liquid in the whirl chamber, as desired.

An annular should 26 of the housing 2 provides a seat for the nozzle against which the filter 25 bears under the influence of the nozzle socket 24, which is fastened to the housing 2 by means of threads 32 and presses the mouthpiece 20 against the whirler 22, the whirler against an elastic sealing O-ring 28 of a thickness of, e.g., 1 mm, the O-ring against the filter 25 and the filter against shoulder 26 of the housing 2. For a satisfactory operation of the nozzle, close contact between the annular shoulder 26 of the housing 2 and the filter 25 as well as between another annular shoulder 30 of the housing 2 and a flange 31 of the socket 24 is required. The threads 32 are not liquid tight.

The sealing ring 28 automatically compensates for deviations in tolerance of the shoulders 26 and 30 with respect to the filter 25 and the flange 31. In addition, it keeps the whole joint tight and enables a relatively loose, i.e., untight installation of the filter 25 on a tap 34 of the whirler 22. As a result, the pressure of the extinguishing liquid can rotate the whirler 2 together with the O-ring 28 and even the filter 25, depending on mutual friction ratios.

In the alternative embodiment of FIG. 5, the whirler 22' has grooves 42 (only one shown) leading to the whirl chamber that are not oblique. However, the whirler 40 comprises a support flange, which is provided with, e.g., four oblique grooves 41 (only one shown) by means of which the pressure of the extinguishing liquid sets the whirler 40 in rotation. Between the support flange and the nozzle seat is an elastic sealing ring 43. The grooves 41 are deeper than the thickness of the sealing ring 43.

The whirler can also be brought into rotation in other ways within the scope of the enclosed claims.

The four nozzles 3 of FIG. 1 are directed obliquely downwards at angles 45°. Especially when the individual nozzles are formed in accordance with the enclosed drawing, in which the nozzles take up relatively little space and can, therefore, be placed close to each other, it is possible to achieve concentration of the fog-like formations of the individual nozzles into a single directional fog spray. The concentration becomes stronger when the operating pressure increases. Then the fog-like formations turn quickly towards each other and are combined thereafter. The concentration effect can be assured by means of a fifth, central nozzle 4 directed straight downwards. Achieving the desired concentration into the fog spray depends on several parameters and, primarily, on the individual spread angles of the respective fog-like formations and mutual main directions or angle of one nozzle to another. A large individual spread angle facilitates contact of the fog-like formations of adjacent nozzles and, thus, their concentration by means of suction.

The resulting fog flow pattern resembles a sponge with a relatively round head. The initial drop size of the nozzles 3 can preferably be about 60 μm, while the drop size of the central nozzle 4 can be about 80 μm.

FIG. 6 shows schematically an embodiment of an installation especially intended for fire fighting in engine rooms of ships and other such spaces. An extinguishing-liquid pump 50 has a driving motor 51. Three pressure governors, preferably adjusted to react at 50 bar, 180 bar and 200 bar, respectively, are indicated at 52, 53, 54, respectively. These feed the extinguishing liquid to five hydraulic accumulators 55 connected in parallel. These are 50 liters each with a charging pressure of about 200 bar and a discharged pressure at rest of about 50 bar to provide an extinguishing liquid (water) volume of about 190 liters. Reference numerals 56, 57, 58 and 61 indicate control valves, the last mentioned of which is preferably manual. Two pneumatic accumulators 59, 62 each have a charging pressure of, e.g., 7 bar. A line extends from the accumulator 59 to the control valves 57 and 58.

The numeral 63 indicates a fire zone, e.g., the engine room in which are placed a number of the spray heads 1. Feeders 64, 65 connect the hydraulic accumulators 55 to the fire zone 63 is indicated by 64, 65. A water (extinguishing liquid) pipe extends to the pump 50 is indicated by 66.

In the rest state of the equipment, the hydraulic accumulators 55 are charged up to 200 bar by the pump 50 and the motor 51, which then stop. The valves 56 are then closed, the pneumatic accumulators 59 and 62 are charged up to 7 bar and the valves 57, 58 and 61 are unactivated.

In case of a fire, an electric alarm signal is produced at the fire centre, which in a ship usually is situated on the bride, and sent to the valve 58. This displaces the spindle of the valve 58, which then sends pressure to a precontrol part of the valve 57, which part moves a spindle of this valve to its opposite end position. The valve 57 sends pressure to a torsional cylinder of the valve 56 and the cylinder moves to its other end position. The valve 56, which may be a ball valve, for example, is now open and the fire extinguishing liquid is now open and (water) flows to the spray head 1.

After the pressure of the hydraulic accumulators 55 has fallen to 50 bar, the pressure governor 52 produces a signal to the valve 58 and also the valve 57 and the valves 56, which are closed. The pump 50 and the motor 51 both receive a starting signal at 180 bar from the pressure governor 53 and charge the hydraulic accumulators 55 up to 200 bar, after which the pump is again stopped by the pressure governor 54. With nozzles according to the embodiment of FIG. 4, the pump 50 can have a volume flow af about 35 liters per minute and the motor 51 a power of 15 kW. The charging time of the hydraulic accumulators 55 will be about 5 minutes, after which the equipment is ready to repeat the same procedure.

The manual value 61 operates in the same way as the valve 58, except that water flows into the system as long as the valve 61 is kept activated. After the pressure has fallen, the valve 61 would have to be closed to recharge the accumulators 55.

The pneumatic accumulators 59 and 62 are kept charged by a compressed-air system (not shown) at the 7 bar indicated.

In the embodiment shown in FIGS. 2 and 3 the force of the spring 10 acting on the spindle 8 is preferably such that the spindle 8, within a pressure range of 200 bar to about 70 bar, takes the position according to FIG. 2 and, within a pressure range of about 70 bar to 50 bar, takes the position according to FIG. 3. Between 200 bar and 70 bar, a volume flow of, typically, 6.5 liters per minute on average can be obtained, and between 70 bar and 50 bar, a flow of about 2 liters per minute.

Equipment like this, when provided with a suitable number of spray heads 1, can provide about 120 liters of extinguishing liquid (water) in approximately 10 seconds within the pressure range of 200 to 70 bar and, after that, about 70 liters of water in approximately 25 seconds within the pressure range of 70 to 50 bar. This is the total 190 liter supply in 35 seconds.

I claim:

1. In a fire-fighting system having a first nozzle and first liquid-supply means for supplying a fire-extinguishing liquid to the first nozzle at a pressure for a first spraying of droplets at a first spread angle from one end of the first nozzle, the improvement comprising:

a second nozzle at a first spacing and a divergent angle of second spraying to the first nozzle;

second liquid-supply means supplying the liquid at the pressure of the first spraying to the second nozzle for the second spraying to be of droplets at a second spread angle from one end of the second nozzle; and entraining means comprising a combination of the pressure of the liquid, sizes of the droplets, the first and second spread angles, the first spacing and divergent angle of the second nozzle to the first nozzle and a second spacing of the first and second nozzles from any surface at opposite ends of the first and second nozzles for entraining the first and second sprayings into a single flow pattern, wherein the pressure is from about 50 bar to about 200 bar.

2. In a fire-fighting system having a first nozzle and first liquid-supply means for supplying a fire-extinguishing liquid to the first nozzle at a pressure for a first spraying of droplets at a first spread angle from one end of the first nozzle, the improvement comprising:

a second nozzle at a first spacing and a divergent angle of second spraying to the first nozzle;

second liquid-supply means supplying the liquid at the pressure of the first spraying to the second nozzle for the second spraying to be of droplets at a second spread angle from one end of the second nozzle; and entraining means comprising a combination of the pressure of the liquid, sizes of the droplets, the first and second spread angles, the first spacing and divergent angle of the second nozzle to the first nozzle and a second spacing of the first and second nozzles from any surface at opposite ends of the first and second nozzles for entraining the first and second sprayings into a single flow pattern, wherein the droplets are from about 60 μm to about 80 μm size, and wherein the pressure is from about 50 bar to about 200 bar.

3. In a method fighting a fire with a fire-fighting system having a first nozzle and first liquid-supply means for supplying a fire-extinguishing liquid to the first nozzle at a pressure for a first spraying of droplets at a first spread angle from one end of the first nozzle, a second nozzle at a first spacing a divergent angle to the first nozzle, and second liquid-supply means supplying the liquid at the pressure of the first spraying to the second nozzle for the second spraying to be of droplets at a second spread angle from one end of the second nozzle, the improvement of entraining the first and second sprayings into a single flow pattern by a combination of the pressure of the liquid, sizes of the droplets, the first and second spread angles, the first spacing and divergent angle of the second nozzle to the first nozzle and a second spacing of the first and second nozzles from any surface at opposite end of the first and second nozzles, wherein the pressure is from about 50 bar to about 200 bar.

4. The method according to claim 3, wherein the pressure decreases from a higher pressure to a lower pressure during the first and second sprayings.

5. Installation for fighting fire, comprising a high pressure drive unit for delivering extinguishing liquid to at least one spray head with a plurality of nozzles directed obliquely to the outside, wherein said at least one spray head further comprises an additional nozzle positioned centrally with respect to said obliquely directed nozzles, and a central connecting channel from the inlet of the spray head to said additional nozzle, with branchings leading from the central connecting channel to said obliquely directed nozzles, wherein said at least one spray head further comprises a spindle with an axial through connection, positioned in said central connecting channel and being movable between a first position in contact with said inlet, thereby closing connection from the inlet to said obliquely directed nozzles while connection from the inlet via the spindle to the centrally positioned nozzle remains, and a second position away from said inlet, thereby opening connection from the inlet to the obliquely directed nozzles, and a spring tending to force the spindle, against the liquid pressure in the inlet of the spray head, into said first position, the force of said spring being selected to resist a reduced operating pressure in the inlet of the spray head and to yield to the full operating pressure, the distance between the nozzles, the spray direction of the nozzles, the spray angle of the nozzles, the orifice size of the nozzles and the liquid pressure being mutually combined in such a manner, that the air flows created by the liquid sprays of the individual nozzles reinforce each other between the nozzles to draw the individual sprays centerwards and effect to a concentration of the individual sprays into a strong main spray.

6. Installation according to claim 5, wherein the force of said spring is adapted to correspond to a pressure of about 70 bar in the inlet of the spray head.

7. Installation according to claim 5, wherein said high pressure drive unit comprises a plurality of hydraulic accumulators connected in parallel.

8. Installation according to claim 7, wherein said hydraulic accumulators have an operating charge pressure of about 200 bar and a discharged pressure at rest of about 50 bar.

9. Installation according to claim 7, further comprising a liquid pump with a high operating pressure and with a volume capacity considerably lower than the amount of liquid required for extinguishing, for charging said hydraulic accumulators.

* * * * *